United States Patent [19]

Kenney

[11] Patent Number: 4,662,545

[45] Date of Patent: May 5, 1987

[54] DISPOSABLE CAPILLARY TUBE DEVICE

[75] Inventor: James W. Kenney, West Chester, Pa.

[73] Assignee: Drummond Scientific Company, Broomall, Pa.

[21] Appl. No.: 568,350

[22] Filed: Jan. 5, 1984

[51] Int. Cl.[4] ..... B67D 5/42

[52] U.S. Cl. ..... 222/386; 604/154; 73/864.16; 73/864.02

[58] Field of Search ..... 222/386, 326, 327, 420; 604/152, 154, 207, 187, 186; 15/210 B; 248/450; 211/60 R, 69; 73/864.16, 864.72, 864.18, 864.02

[56] References Cited

U.S. PATENT DOCUMENTS

| | | | |
|---|---|---|---|
| 2,254,662 | 9/1941 | Naples et al. | 15/210 B |
| 3,153,496 | 10/1964 | Johnson | 604/207 |
| 3,401,692 | 9/1968 | Harris, Jr. | 604/207 |
| 3,809,298 | 5/1974 | Harris et al. | 222/386 |
| 4,003,262 | 1/1977 | Gerarde et al. | 73/864.02 |
| 4,023,716 | 5/1977 | Shapiro | 73/864.13 |
| 4,050,316 | 9/1977 | Rapoza | 73/864.16 |
| 4,063,662 | 12/1977 | Drummond et al. | 604/207 |
| 4,404,862 | 9/1983 | Harris, Sr. | 604/207 |

FOREIGN PATENT DOCUMENTS

| | | | |
|---|---|---|---|
| 836207 | 3/1970 | Canada | 15/210 B |
| 960103 | 4/1950 | France | 222/386 |

*Primary Examiner*—Joseph J. Rolla
*Assistant Examiner*—Kenneth Noland
*Attorney, Agent, or Firm*—John F. A. Earley; John F. A. Earley, III

[57] ABSTRACT

A disposable capillary tube device has a support member to which a capillary tube is secured with one end of the tube extending beyond the support member for the pickup of a liquid. A plunger is releasably mounted for axial movement on the support member with space for the passage of air out of the capillary tube as it picks up liquid. The plunger is mounted on the axis of the capillary tube for passage through the capillary tube to expel liquid from the capillary tube.

14 Claims, 16 Drawing Figures

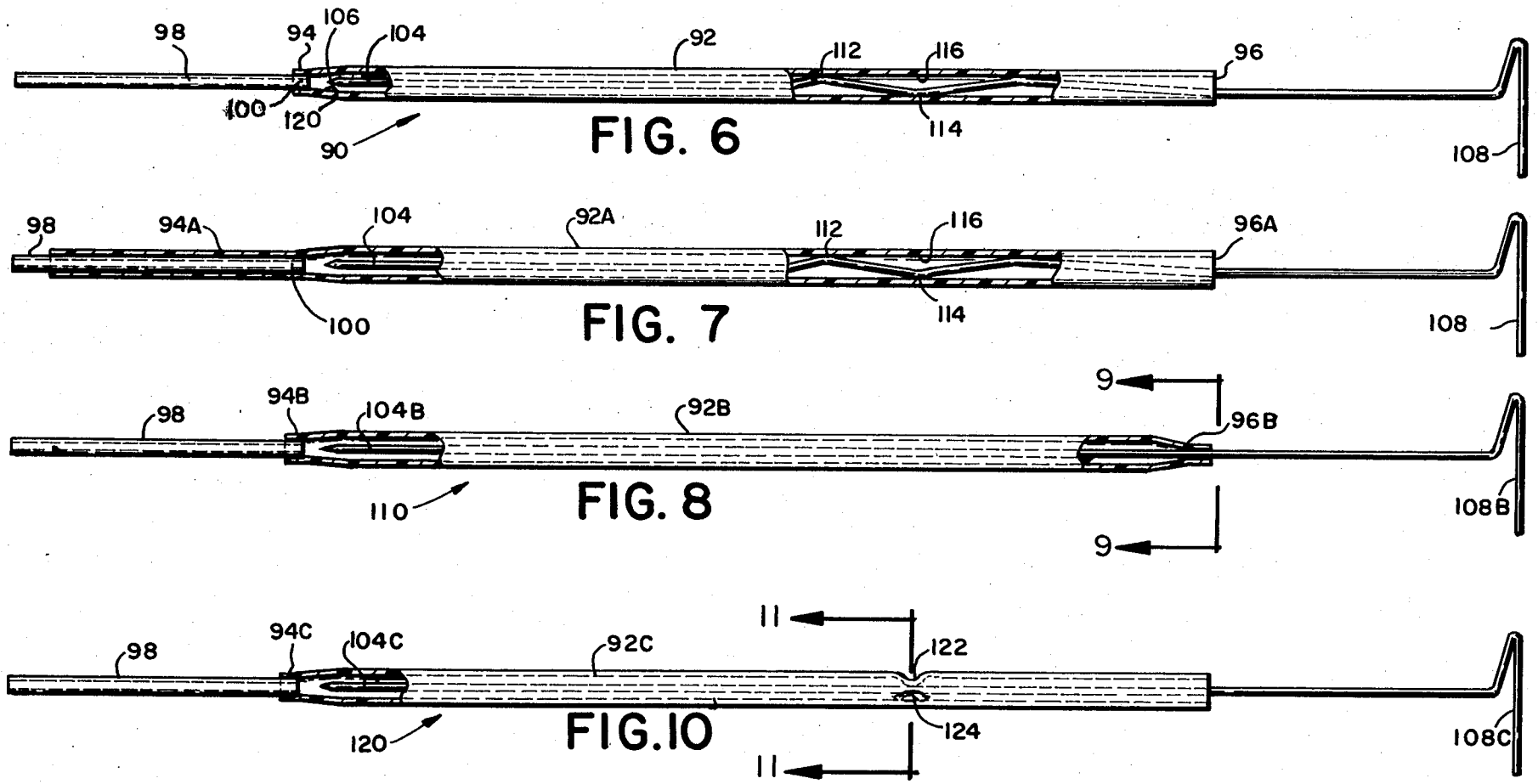
FIG. 6
FIG. 7
FIG. 8
FIG. 10
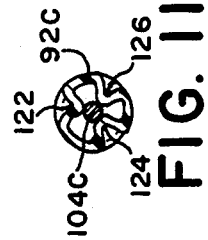
FIG. 11
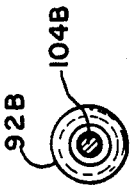
FIG. 9

DISPOSABLE CAPILLARY TUBE DEVICE

TECHNICAL FIELD

This invention is in the field of fluid handling.

BACKGROUND OF THE PRIOR ART

Devices for picking up and discharging liquid, for example blood, employing a capillary tube are well-known to the art. U.S. Pat. Nos. 3,828,987 and 3,720,354 each disclose a capillary tube containing a piston which is withdrawn to pick up liquid and advanced to discharge liquid. The presence of the piston in the capillary tube while liquid is being drawn into the tube is a disadvantage when consistent accuracy is desired since it can cause the presence of an air bubble in the capillary tube. While the prior art recognizes the desirability of having such devices disposable, it still contemplates using operating parts to be removed from the disposable capillary tube and piston for reuse. This involves time-consuming operations. These problems are solved in this invention by providing a capillary tube mounted on a support member in alignment with a piston with space for the passage of air from the capillary tube as it picks up liquid. The entire unit can be disposed of after use.

BRIEF SUMMARY OF THE INVENTION

A disposable capillary tube device has a support member to which a capillary tube is secured with one end of the tube extending beyond the support member for the pickup of a liquid. A plunger is releasably mounted for axial movement on the support member with space for the passage of air out of the capillary tube as it picks up liquid. The plunger is mounted on the axis of the capillary tube for passage through the capillary tube to expel liquid from the capillary tube.

BRIEF DESCRIPTION OF THE DRAWINGS

FIG. 6 is a plan view, partially broken away, of another disposable capillary tube device in accordance with the invention.

FIG. 7 is a plan view, partially broken away of another disposable capillary tube device in accordance with the invention.

FIG. 8 is a plan view, partially broken away, of another disposable capillary tube device in accordance with the invention.

FIG. 9 is a vertical section taken on the plane indicated by the line 9—9 in FIG. 8.

FIG. 10 is a plan view, partially broken away, of another disposable capillary tube device in accordance with the invention.

FIG. 11 is a vertical section taken on the plane indicated by the line 11—11 in FIG. 10.

DETAILED DESCRIPTION

Figure 1:
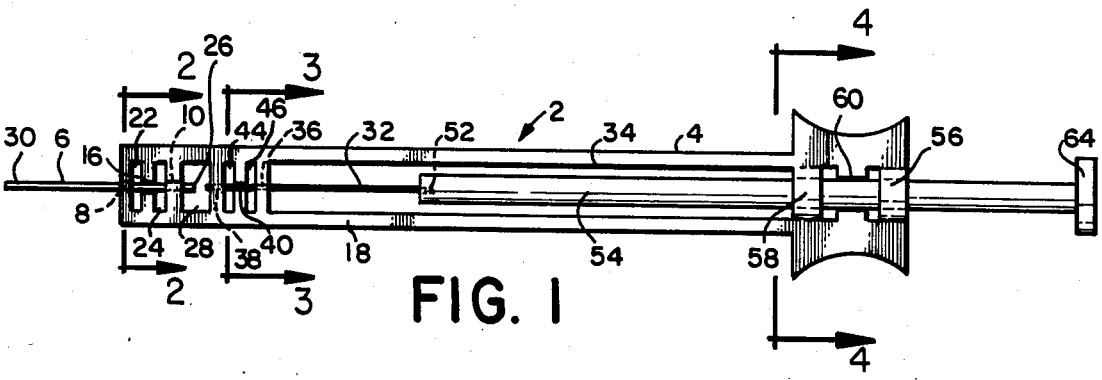
FIG. 1 is a left side elevational view of a capillary tube device in accordance with the invention.
Figure 2:
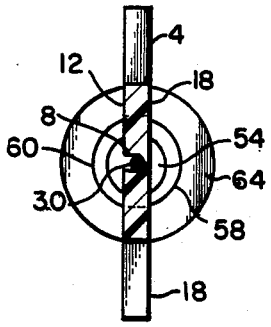
FIG. 2 is a vertical section taken on the plane indicated by the line 2—2 in FIG. 1.

A capillary tube device 2 (FIG. 1) has a card 4 advantageously of a plastic (synthetic resin) material, for example a polyalkylene resin such as polyethylene or polypropylene, or cellulose acetate butyrate, or cellulose acetate propionate.

A capillary tube 6 is secured by a pressed fit in identical slots 8 and 10 in the right side 12 of card 4 and in a similar slot 16 in the left side 18 of card 4. The tube 6 is placed in the slots by sliding the tube axially into the slots. Card 4 has an opening 22 therethrough between slots 8 and 16 and an opening 24 therethrough between slots 10 and 16. The inner end 26 of tube 6 overlies an opening 28 in card 4 to permit viewing the tube 6 to see if it is full of liquid. The outer end 30 extends beyond card 4 to facilitate the picking up of a liquid.

Figure 3:
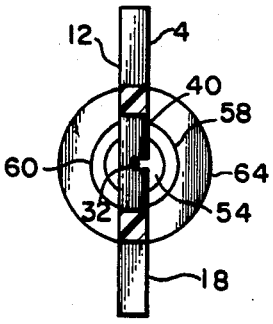
FIG. 3 is a vertical section taken on the plane indicated by the line 3—3 in FIG. 1.
Figure 4:
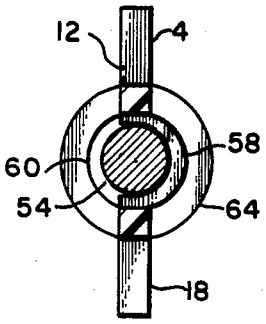
FIG. 4 is a vertical section taken on the plane indicated by the line 4—4 in FIG. 1.

A wire piston 32 having a diameter to fit snugly inside capillary tube 6, is received in an opening 34 through card 4 and is retained by a pressed fit in slots 36 and 38 in the right side 12 of card 4 and in a similar slot 40 (FIG. 3) in the left side 18 of card 4 which has openings 44 and 46 therethrough which lie respectively between slots 38 and 40 and slots 36 and 40.

Piston 32 is secured by a pressed fit in an opening 52 in piston rod 54. Piston rod 54 is slidably retained on card 4 by straps 56 and 58 integral with card 4 on one side of rod 48 and strap 60 integral with card 4 on the opposite side of rod 48. Straps 56, 58 and 60 keep the axis of piston rod 54 in alignment with the axis of capillary tube 6. Piston rod 54 has an enlarged end 64 to facilitate its manipulation. Piston 32 and piston rod 54 are mounted on card 4 by axially sliding them into the position shown in FIG. 1 where they are frictionally held in place until used.

In operation the device 2 is moved to bring end 30 of capillary tube 6 into contact with the liquid to be picked up. The liquid fully fills tube 6 by capillary action, air being free to pass out of tube 6. The capillary tube 6 is selected to provide the precise amount of liquid to be picked up. Since the wire piston 32 is withdrawn from the capillary tube 6, there is positive assurance that no air bubbles will be formed in capillary tube 6, thus insuring the accuracy of the amount of liquid picked up. The device 2 is then moved to a position with the capillary tube 6 at the desired point of discharge at which time piston rod 54 is advanced causing wire piston 32 to enter capillary tube 6 and move through the capillary tube to discharge all of the contained liquid.

Figure 5:
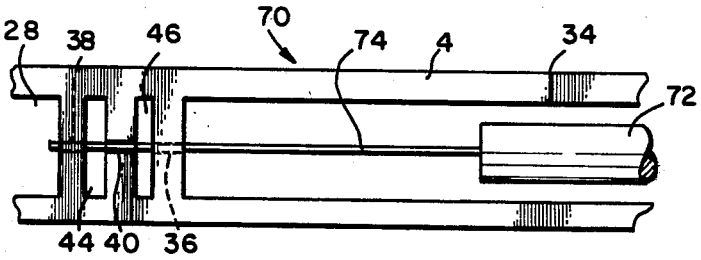
FIG. 5 is a left side elevational view of a capillary tube device of the invention, partially broken away and showing a modified piston and piston rod.

An alternative capillary tube device 70 (FIG. 5) is identical with device 2 except piston 74 is plastic and integral with plastic piston rod 72.

Adverting to FIG. 6, a disposable capillary tube device 90 in accordance with the invention has a transparent support tube 92 having a forward end 94 and a rear end 96. A capillary tube 98 has its inner end 100 retained inside the outer end 94 of retaining tube 92 by a pressed fit.

A wire plunger 104 has a pointed forward end 106 to facilitate entry into capillary tube 98. The pointed end 106 is spaced away from the capillary tube 98. Plunger 104 has a bent rear portion 108 forming a handle exterior of support tube 92. Intermediate end 106 and handle 108, plunger 104 has opposed bent portions 112 and 114 frictionally engaging the inner wall 116 of support tube 92 to hold plunger 104 in support tube 92 and spaced away from capillary tube 98 until it is desired to advance the plunger 104 into capillary tube 98 to expel liquid picked up by the capillary tube. The outer diameter of the wire from which plunger 104 is formed is smaller than the inner diameter of support tube 92 in order to permit the passage of air through support tube 92 when capillary tube 98 is picking up a liquid. The inner wall 116 of support tube 92 is funneled in the area indicated at 120 to facilitate the entry of plunger 104 into capillary tube 98 which is also facilitated by pointed end 106.

FIG. 7 shows the device of FIG. 6 modified by providing a support tube 92A which is identical with support tube 92 with the exception of having an extended forward reduced diameter portion 94A which holds capillary tube 98 by a pressed fit and extends over most (advantageously over 80%) of the capillary tube 98 leaving only a small portion projecting for the pickup of liquid. The portion 94A provides protection against breakage of capillary tube 98. The thus modified device of FIG. 6 is the preferred embodiment of the invention.

A modified device 110 in accordance with the invention is shown in FIG. 8. The device 110 is the same as the device of FIG. 6 with the exceptions that plunger 104B does not have the bent portions 112 and 114 found in plunger 104 and support tube 92B has its rear end 96B formed into a reduced diameter portion to engage plunger 104B with sufficient friction to retain it in support tube 92B spaced from capillary tube 98 until it is desired to advance it through the capillary tube.

An alternative device 120 in accordance with the invention is shown in FIG. 10. The device 120 is identical with the device of FIG. 6 except it employs a modified plunger 104C which eliminates the bent portions 112 and 114 of plunger 104 and the support tube 92C of the device 120 differs from the support tube 92 of the device of FIG. 6 in having three inwardly extending bosses 122, 124 and 126 spaced apart 120° and engaging plunger 104C with sufficient friction to hold it in mounting tube 92C spaced from capillary tube 98 until it is desired to advance the plunger to expel liquid from capillary tube 98.

Figure 12:
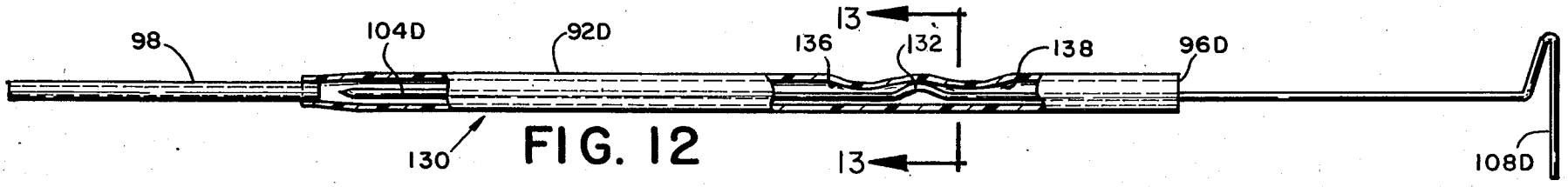
FIG. 12 is a plan view, partially broken away, of another disposable capillary tube device in accordance with the invention.
Figure 14:
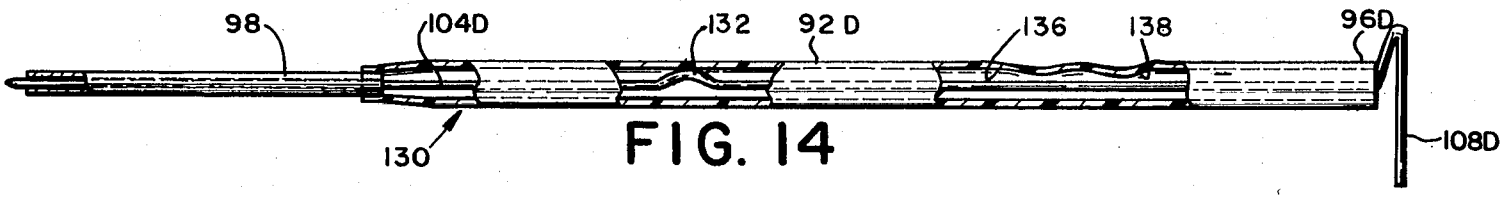
FIG. 14 is a plan view of the device of FIG. 12 showing the plunger advanced through the capillary tube.
Figure 13:
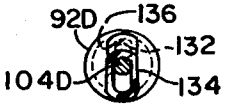
FIG. 13 is a vertical section taken on the plane indicated by the line 13—13 in FIG. 12.

An alternative device 130 in accordance with the invention shown in FIG. 12 is the same as the device of FIG. 6 with the exceptions that a plunger 104D has a single bent portion 132 retained between a flattened portion 134 (FIG. 13) of retaining tube 92D which also has an inwardly extending boss 136 on one side of bent wire portion 132 and inwardly extending boss 138 on the other side of bent wire portion 132. The bosses retain the plunger 104D in mounting tube 92D spaced from capillary tube 98 until it is desired to advance the plunger 104D through the capillary tube 98 at which time the user urges plunger 104D towards capillary tube 98 which causes bent portion 132 to engage boss 136 and be deformed sufficiently to permit the bent portion 132 to pass beyond boss 136 as shown in FIG. 14. The flattened portion 134 of tube 92D prevents the rotation of the bent portion 132 and hence keeps it in alignment with the bosses 136 and 138.

Figure 15:
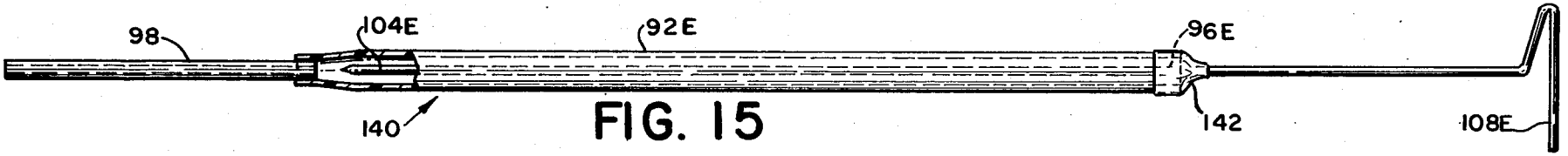
FIG. 15 is a plan view, partially broken away, of another disposable capillary tube device in accordance with the invention.

A device 140 in accordance with the invention is shown in FIG. 15. Device 140 is the same as the device shown in FIG. 6 with the exception that the plunger 104E does not have the bent portions 112 and 114 of plunger 104 and plunger 104E is held in its preoperating position by means of a piece of tape 142 adhesively secured to the end 96E of mounting tube 92E and to plunger 104E by an adhesive (not shown). The plunger 104E can be separated from tape 142 either by simply advancing the plunger towards the capillary tube 98 or by removal of the tape 142 from support tube 92E and plunger 104E.

Figure 16:
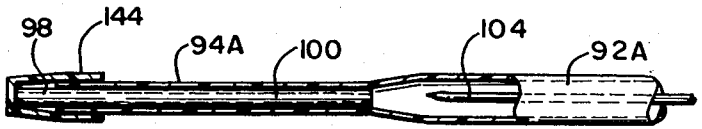
FIG. 16 is a view, partly broken away, of the capillary tube device of FIG. 7 with a cap added that provides protection to the capillary tube.

FIG. 16 discloses capillary tube device of FIG. 7 with a synthetic plastic cap 144 having a tapered inner diameter which forms a press fit with the free end of support tube 92A to further protect the pickup end of capillary tube 98 before use. When used, of course, the cap 144 is first removed from support tube reduced diameter portion 94A.

It is advantageous to make the support tubes of a transparent material since this permits observing when the liquid being picked up has filled the capillary tube and also permits viewing the entry of the plunger into the capillary tube. It is preferred to use a thermoplastic material such as an acrylic resin, such as methyl methacrylate, a polycarbonate resin or polystyrene to form the support tube since with these materials it is easy to reduce the tube diameter at a desired point, flatten the tube or indent bosses into the tube by simple deformation of the tube when it is in the plastic state. Glass may be employed but, being relatively fragile, it is not a preferred material. Many other materials obviously may be employed such as thermosetting plastics which may be molded to the desired shape.

It will be understood that the above embodiments are intended to be illustrative and not limiting.

I claim:

1. A disposable capillary tube device comprising a support member, capillary tube means mounted on the support member and having an outer end and an inner end with the outer end extending beyond the support member for picking up a liquid by capillary action and a plunger mounted on the support member and releasably mounted for axial movement on the support member with space for the passage of air out of the inner end of the capillary tube as the capillary tube picks up liquid, said space for the passage of air being open to the atmosphere outside the device to prevent air from being trapped inside the support member as liquid is being picked up, and said plunger being mounted substantially on the axis of the capillary tube for passage through the capillary tube to discharge liquid from the capillary tube.

2. A disposable capillary tube device comprising a card, a capillary tube, means for securing the capillary tube to the card with one end of the tube extending beyond the card for the pickup of a liquid, a plunger adapted to cooperate with the capillary tube to discharge liquid from the capillary tube, means for securing the plunger to the card with the axis of the plunger substantially in line with the axis of the capillary tube and with the plunger spaced from the tube for axial movement for passage through the tube to drive liquid out of the tube.

3. A device in accordance with claim 2 in which the means for securing the capillary tube to the card comprises slots in the card and the means for securing the plunger to the card comprises a plurality of opposed raised bands integral with the card engaging opposite sides of the plunger and slidably holding the plunger on the axis of the capillary tube.

4. A disposable capillary tube device comprising an elongated hollow support member, capillary tube means having an outer end and inner end with its inner end secured in the hollow support member, and a plunger having an inner end and an outer end mounted on the support member and releasably mounted for axial movement in the support member with its inner end spaced from the inner end of the capillary tube and with space between the plunger and the support member for the passage of air as the capillary tube picks up liquid by capillary action, said space for the passage of air being open to the atmosphere outside the device to prevent air from being trapped inside the support member as liquid is being picked up, and said plunger being adapted to being advanced to and through the capillary tube and to discharge liquid picked up by the capillary tube.

5. A device in accordance with claim 4 in which the hollow support member has an extension portion which extends over a substantial portion of the capillary tube to protect the capillary tube from being broken.

6. A device in accordance with claims 4 or 5 in which the plunger is a wire having a pointed inner end.

7. A device in accordance with claim 4 in which the plunger is a wire having at least one bent portion engaging the inside of the hollow support member for frictionally holding the plunger in place when not in use.

8. A device in accordance with claim 4 in which the support member has a reduced diameter portion frictionally engaging the plunger to hold the plunger in position when not in use.

9. A device in accordance with claim 4 in which the plunger has a portion deviating from its axis which is retained by inwardly extending portions of the hollow support member on either side of the first mentioned portion.

10. A device in accordance with claim 4 in which the plunger is retained in position when not in use by a member removably attached to the exterior of the hollow support member and to a portion of the plunger exterior of the hollow support member.

11. A device in accordance with claim 5 in which a cap is press fit onto the free end of said hollow support member extension portion to further protect the capillary tube from being broken.

12. A disposable capillary tube device comprising an elongated hollow support member, capillary tube means having an outer end and inner end with its inner end secured in the hollow support member, and a plunger having an inner end and an outer end mounted on the support member and releasably mounted for axial movement in the support member with its inner end spaced from the inner end of the capillary tube and with space for passage of air out of the capillary tube as the capillary tube picks up liquid by capillary action, said space for the passage of air being open to the atmosphere outside the device to prevent air from being trapped inside the support member as liquid is being picked up, and said plunger being adapted to being advanced to and through the capillary tube and to discharge liquid picked up by the capillary tube, in which the hollow support member has an extension portion which extends over a substantial portion of the capillary tube to protect the capillary tube from being broken, in which the plunger is a wire having a pointed inner end, in which the plunger is a wire having at least one bent portion engaging the inside of the hollow support member for frictionally holding the plunger in place when not in use, in which a cap is press fit onto the free end of said hollow support member extension portion to further protect the capillary tube from being broken.

13. A disposable capillary tube device comprising a support member, a capillary tube, means for securing the capillary tube to the support member with one end of the tube extending beyond the support member for the pickup of a liquid, a plunger adapted to cooperate with the capillary tube to discharge liquid from the capillary tube, means for securing the plunger to the support member with the axis of the plunger substantially in line with the axis of the capillary tube and with the plunger spaced from the tube for axial movement for passage through the tube to drive liquid out of the tube, the space between the plunger and the capillary tube being open to atmosphere outside of the device to prevent air from being trapped inside the support member as liquid is being picked up by the capillary tube.

14. Method of providing a precise volume of liquid comprising the steps of contacting the liquid with the outer end of a capillary tube of a desired length to pick up a desired volume of liquid, filling the tube with the liquid by capillary action, causing the filling liquid to force any air in the tube out of the tube from the inner end of the tube, moving the tube to the desired point of discharge, and discharging the liquid from the tube by passing a plunger into the tube from the inner end through the tube to the outer end, the above step of forcing any air in the capillary tube out of the capillary tube comprises providing a spacing between the plunger and the capillary tube, prior to passing the plunger into the capillary tube, and the spacing is open to atmosphere outside the capillary tube to prevent air from being trapped inside the capillary tube.

* * * * *